United States Patent [19]

Behm

[11] Patent Number: 4,829,718

[45] Date of Patent: May 16, 1989

[54] GRINDING WHEEL ASSEMBLY AND METHOD

[76] Inventor: Michael E. Behm, Behm Balancing Devices, P.O. Box 40252, Bay Village, Ohio 44140

[21] Appl. No.: 32,023

[22] Filed: Mar. 30, 1987

Related U.S. Application Data

[63] Continuation-in-part of Ser. No. 796,308, Nov. 7, 1985, abandoned.

[51] Int. Cl.[4] ..... B24B 41/00

[52] U.S. Cl. ..... 51/168; 29/426.6; 29/446

[58] Field of Search ..... 51/168; 29/426.6, 446, 29/421 R

[56] References Cited

U.S. PATENT DOCUMENTS 2,980,474 4/1961 Gargan ..... 29/426.5

*Primary Examiner*—Frederick R. Schmidt
*Assistant Examiner*—Maurina Rachuba
*Attorney, Agent, or Firm*—Renner, Otto, Boisselle & Sklar

[57] ABSTRACT

A grinding wheel mounting apparatus and method of demounting is characterized by a shaft having a tapered end portion, a wheel adaptor including a tapered axial bore for mounting on the tapered end portion of the shaft. The hole and tapered end portion of the shaft have correspondingly tapered surfaces frictionally engaging over an area of contact to couple the adaptor to the shaft for common rotation. A fluid passage means is provided for directing pressurized fluid to a point within the confines of the area of contact so that the pressure of such fluid may exert both radial and axial forces on the adaptor to effect its release from the shaft. A removal fitting is also disclosed which may be threaded on to the shaft. The removal fitting has an O-ring seal to provide a fluid tight seal with the shaft and a grease fitting. An internal passage in the removal fitting enables grease under pressure to flow to the fluid passage means. The removal fitting is proportioned to permit only loosening of the object mounted to the shaft until the removal fitting itself is removed.

6 Claims, 1 Drawing Sheet

GRINDING WHEEL ASSEMBLY AND METHOD

RELATED APPLICATION

This application is a continuation-in-part of U.S. application Ser. No. 796,308, filed Nov. 7, 1985, now abandoned and which is hereby incorporated herein by reference.

DISCLOSURE

The invention herein described relates generally to mounting assemblies for grinding wheels or the like and more particularly to a tapered shaft mounting assembly and related method which provide for easy and quick demounting of the grinding wheel or similar object mounted on the shaft.

BACKGROUND

Mounting adaptor assemblies heretofore have been used to mount grinding wheels or the like to the tapered ends of rotatably driven shafts. Typically, the grinding wheel is concentrically mounted on an adaptor which has a tapered axial center bore for mounting on the correspondingly tapered end of the rotatably driven shaft. The shaft has been provided with a threaded cylindrical end portion onto which an adaptor lock nut is threaded to hold the adaptor in tight frictional engagement with the taper of the shaft. The angle of the taper is selected to ensure positive gripping of the adaptor on the shaft for common rotation. Pulleys to drive to be driven by a belt have been similarly mounted to a shaft.

Because of the snug fit of the adaptor or pulley on the tapered end of the shaft, demounting of the adaptor or pulley has been difficult. A common practice has been to pry or hammer the adaptor or pulley to effect its release from the shaft, but this may result in damage to it or the shaft and also to other components of the apparatus in which the shaft is mounted. Another practice has been to use a gear puller or similar tool to release the adaptor or pulley, but this was a relatively time consuming task and there was still the possibility of damaging the adaptor or pulley.

SUMMARY OF THE INVENTION

The present invention provides a mounting assembly and method for grinding wheels or the like which provide for relatively easy and quick demounting of a wheel adaptor from a tapered shaft while eliminating the possibility of damage to the wheel adaptor, shaft and/or other components of the apparatus in which the shaft is mounted. In accordance with the invention, the mounting assembly comprises a shaft having a tapered end portion, a wheel adaptor including a tapered axial bore for mounting on the tapered end portion of the shaft, the bore and tapered end portion having correspondingly tapered surface frictionally engageable over an area of contact to couple the adaptor to the shaft for common rotation and to provide a fluid seal at such area of contact, and fluid passage means for directing pressurized fluid to a point within the confines of such area of contact so that the pressure of such fluid may exert both radial and axial forces on the adaptor to effect its release from the shaft. The fluid passage means preferably is provided with an accessible inlet fitting for connection to a source of pressurized fluid such as a grease gun and, in accordance with the method of the invention, fluid under sufficient pressure is delivered to the inlet fitting for passage through the fluid passage means, the pressurized fluid operating to radially outwardly expand and axially shift the wheel adaptor relative to the shaft to effect its release from the shaft.

In another embodiment a removal fitting is provided which may be threaded onto the shaft. The removal fitting includes at one end an accessible inlet fitting such as a grease fitting. An internal passage through the removal fitting establishes fluid communication between the grease fitting and the fluid passage means in the shaft.

These and other features of the invention are hereinafter fully described and particularly pointed out in the claims, the following description and annexed drawings setting forth in detail certain illustrative embodiments of the invention, these being indicative, however, of but a few of the various ways in which the principles of the invention may be employed.

DETAILED DESCRIPTION

Figure 1:
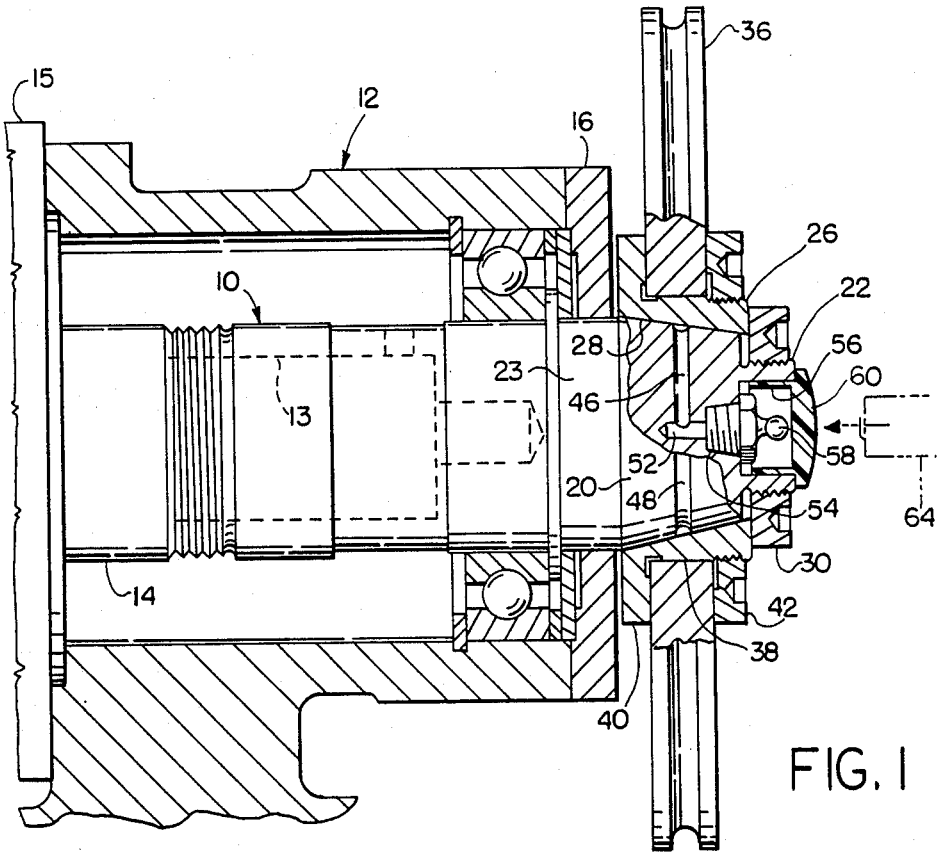
FIG. 1 is a diametrical sectional view through a mounting assembly for a grinding wheel according to the invention with the shaft thereof being shown part in section and part in elevation.

With reference to FIG. 1, the illustrated mounting assembly for a grinding wheel or the like comprises a shaft 10 which may be conventionally mounted for rotation about its axis in a shaft housing 12. At its inner end, the shaft 12 includes an axial bore 13 for conventional coupling to the end of a spindle 14 of a motor 15. At its other end which extends outwardly through an opening in a housing end cap 16, the shaft has a tapered end portion 20 and a cylindrical terminal end portion 22, the latter being of lesser diameter than the smaller diameter end of the tapered end portion 20. An inner cylindrical portion 23 of the shaft, if desired, may be lengthened to project outwardly beyond the end cap and the projecting portion thereof may be provided with diametrically opposed flats at which the shaft may be engaged by a wrench when needed.

The mounting assembly also comprises a wheel adaptor 26 which has a tapered axial center bore 28 for mounting on the tapered end portion 20 of the shaft 10 as shown. The wall or surface of the center bore 28 and the outer conical surface of the tapered end portion of the shaft are correspondingly tapered to provide for snug frictional and fluid sealing engagement over their area of circumferential contact. As will be appreciated, the adaptor may be axially slipped over the tapered end portion of the shaft and then clamped with a tight wedge-like fit against the taper of the shaft by an adaptor lock nut 30 secured onto the threaded cylindrical terminal portion 22, as in well known manner.

As shown, a grinding wheel 36 may be concentrically mounted at a cylindrical center bore thereof on the outer cylindrical surface 38 of the adaptor between an annular radial flange 40 at the inner end of the adaptor and a wheel mounting nut 42 screwed onto the externally threaded outer end of the adaptor. The wheel mounting nut normally is tightened to clamp the wheel 36 between such nut and the flange such that the wheel will rotate with the adaptor which in turn rotates with the shaft.

In accordance with the invention, the shaft 10 has formed therein a radially extending fluid passage 46 which opens to the tapered outer surface of the tapered end portion 20 of the shaft at an annular groove 48 formed in such surface. The annular groove 48 is located within and thus confined by the area of contact between the tapered surfaces of the adaptor and shaft and preferably about axially half way between the axial ends of such area of contact as shown. For purposes of carrying out the present invention, the correspondingly tapered surfaces are so formed, as within a close tolerance and with a smooth surface finish, to provide not only a snug friction fit but also to provide a circumferentially continuous fluid seal at each axial side of the groove.

The radially inner end of the radially extending passage 46 intersects and hence is in fluid communication with the inner end of an axially extending fluid passage 52 which opens to a threaded tapered counterbore 54 which in turn opens to a larger diameter cylindrical counterbore 56 at the outer axial end of the shaft 10. The tapered counterbore has a grease fitting 58 threaded therein with the nipple of such fitting being accommodated within the larger diameter counterbore 56. As shown, a cap 60 may be provided normally to close the larger diameter counterbore 56 to protect the nipple of the grease fitting as during normal use of the grinding wheel.

Turning now to the method of the invention, it is noted that once the wheel adaptor 26 has been snugly fitted and clamped to the tapered end portion 20 of the shaft 10 for use in carrying out, for example, a grinding operation, the wheel adaptor usually will remain frictionally locked to the shaft even after removal of the adaptor lock nut 30. That is, an operator normally would not have sufficient strength to pull the wheel adaptor axially off of the shaft as may be needed when replacing the grinding wheel with another grinding wheel.

In accordance with the method of the invention, demounting of the wheel adaptor 26 may be easily accomplished as follows. After the adaptor lock nut 30 and protective cap 60 have been removed from the shaft 10, a source of pressurized fluid may be connected to the fitting 58. As is preferred, the source of pressurized fluid may be a hand pumped grease gun having a nozzle (shown in phantom at 64) which may be coupled to the grease fitting to inject grease under pressure into the annular groove 48 via the passages 52 and 46 in the shaft. The grease forced into the annular groove will exert forces against the tapered inner diameter surface of the wheel adaptor, such force applied having a radially outwardly extending component which operates to radially outwardly expand the wheel adaptor and also an axially outwardly extending component which operates to shift the wheel adaptor axially outwardly in relation to the shaft. It is noted that upon radial expansion and axial shifting of the adaptor, the seal formed by the contacting tapered surfaces of the wheel adaptor and shaft will be broken such that grease will then flow from the groove and between the adaptor and shaft. This of course will result in a reduction in the force acting on the adaptor but by the time the adaptor contracts to its original diameter, the adaptor will have been shifted axially to a smaller diameter section of the tapered end portion of the shaft from which it can be easily removed by hand. For re-use, the tapered surfaces of the adaptor shaft may be wiped free of any grease before reassembly in the above indicated manner.

As above indicated, the adaptor lock nut 30 may be completely removed from the shaft 10 before the grease is injected into the annular groove. Preferably, however, the adaptor lock nut is not completely removed but innstead is backed away from the wheel adaptor by several threads to permit axial shifting of the wheel adaptor while acting as an axial stop to prevent the wheel adaptor from falling or flying off the shaft accidentally. This is particularly important if a source of high pressure fluid, such as an air-powered grease gun, is used to release the wheel adaptor. If the adaptor lock nut were completely removed, high fluid pressure could cause the adaptor to fly off the shaft, and this may cause injury or damage the adaptor or wheel.

As will be appreciated, the aforedescribed demounting of the wheel adaptor from the tapered shaft can be accomplished easily, quickly, safely and without damage to the wheel adaptor, wheel, shaft or components of the assembly in which the shaft is mounted.

Figure 2:
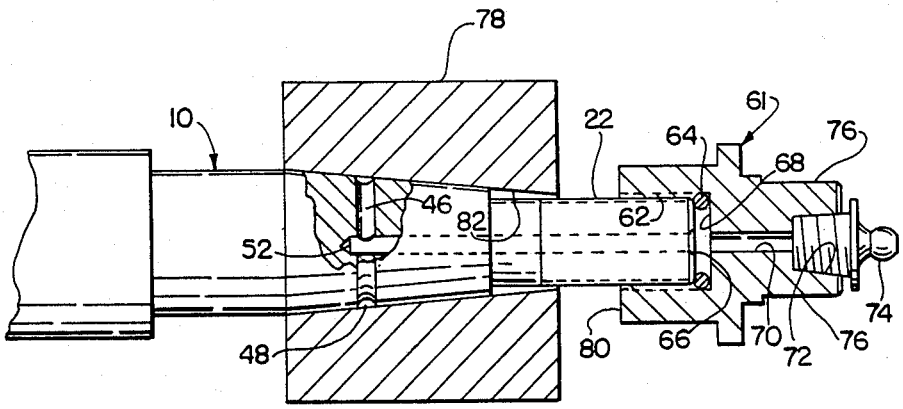
FIG. 2 is a diametrical sectional view illustrating a second embodiment of the present invention.

FIG. 2 illustrates a second embodiment of the present invention. In FIG. 2 the same numerals have been used to identify parts corresponding generally to those identified in FIG. 1 by such numerals. In FIG. 2, removal fitting 61 is threaded onto the cylindrical end portion 22 of the shaft 10. The shaft includes axial bore 52, radial bore 46, and circumferential groove 48 which are similar to those in the embodiment of FIG. 1. The removal fitting 61 is provided with the threaded counterbore 62 with threads that mate with the threads on end portion 22 of the shaft 10. The rubber O-ring 64, upon tightening of the removal fitting on the shaft 22, is compressed between an axial end face 66 of the shaft 10 and the bottom 68 of the counterbore 62. The O-ring together with the threaded engagement between the removal fitting 61 and the end portion 22 makes a fully tight seal between the removal fitting 61 and shaft 10.

A central cylindrical passage 70 extends through the removal fitting 61, communicating at one end with the threaded counterbore 62 and at the other end with a tapered counterbore 72. The tapered counterbore 72 is threaded to receive a conventional grease fitting 74.

The exterior of the removal fitting 61 has a generally circular or cylindrical symmetry except that it is provided with an opposing pair of flats 76 that may be easily gripped by a wrench.

The depth of the threaded counterbore 62 is selected so that once the retaining nut (30 in FIG. 1) is removed, the removal fitting 61 may be threaded into place with the rubber O-ring 64 tightly in place between the end face 66 and the bottom 68 of counterbore 62 while still leaving some clearance between a pulley 78 or other object mounted on the shaft 10 and end face 80 of the removal fitting. Preferably, the removal fitting 61 has a maximum diameter which is greater than the minimum diameter of the tapered passage 82 through the pulley 78. This provides a safety factor in that the pulley 26 cannot fall from the shaft 10 until the removal fitting 61 is removed from the shaft 10.

The operation of the removal fitting 61 is much like that of the previous embodiment except that the removal fitting 61 may be used where it is not desired to have a permanent grease fitting installed on the shaft 10 as in the FIG. 1 embodiment. In this case, it is necessary only to remove the lock nut (not shown in FIG. 2) and to install in its place the removal fitting 61. Thereafter, a conventional grease gun, preferably a manually operated grease gun, is attached to the grease fitting 74, and grease is pumped through the passage 70 into the passage 52, from there flowing through passages 46 and into passage 48 to exert pressure on the pulley 78 effective to remove it from the shaft 10. Once the seal between the adaptor 26 and shaft 10 has been broken, the removal fitting 61 may be unscrewed from the shaft 22 and the pulley 78 may be replaced.

Although the invention has been shown and described with respect to preferred embodiments, it is obvious that equivalent alterations and modifications will occur to others skilled in the art upon the reading and understanding of this specification. The present invention includes all such equivalent alterations and modifications, and is limited only by the scope of the following claims.

What is claimed is:

1. A method of releasing an article from a shaft, the shaft having a tapered portion and a threaded portion axially outward of the tapered portion, the article having an internal taper for mounting on the tapered portion of the shaft at correspondingly tapered surfaces in frictional and fluid sealing engagement over an area of contact therebetween, and the shaft having an internal passage from an end face thereof to the tapered surfaces of the shaft and article, said method comprising the steps of threading a removal fitting onto the threaded portion of the shaft, the removal fitting having an internally threaded counterbore formed in an end face thereof for receipt on the threaded portion of the shaft, a grease fitting fixed to the outer end of the removal fitting, and an internal passage through the removal fitting connecting the grease fitting to the counterbore at a location permitting fluid communication with the internal passage in the shaft; coupling a source of pressurized grease to the grease fitting of the removal fitting; and then causing grease under pressure to pass from the source of pressurized grease through the removal fitting via the internal passage thereof to the internal passage in the shaft for application against an interior surface of the article surrounded by such area of contact to exert forces causing the article to radially expand and axially shift relative to the shaft to effect release of the article from the shaft: and wherein the removal fitting when threaded on the shaft is axially spaced away from the article to permit limited axial shifting of the article while acting as an axial stop to prevent the article from falling or flying off the shaft upon application of fluid pressure against the interior surface of the article.

2. The removal fitting of claim 6 including a resilient O-ring positioned to be compressed between the end face of the shaft and a bottom surface of said first counterbore.

3. The removal fitting of claim 6 wherein said member includes wrench flats formed on the exterior thereof to facilitate installation and removal of said removal fitting.

4. A method as set forth in claim 1, wherein the article is a grinding wheel adaptor for a grinding wheel or the like.

5. A method as set forth in claim 1, including the step of directing such fluid under pressure to a groove formed in the tapered surface of the shaft.

6. A removal fitting removably attached to a shaft having a tapered portion mating with an internal taper on an article mounted on said shaft, a threaded portion axially outward of said taper, and an internal passage from an end face of said shaft to the mating tapered surfaces of said shaft and article, said removal fitting comprising a generally cylindrical member having axially inner and outer ends, a first internally threaded counterbore opening to an axially outer end face of said member and proportioned to engage said threaded portion of said shaft, a grease fitting fixed to the outer end of said cylindrical member, and an internal passage in said cylindrical member connecting said grease fitting to said counterbore, and said member having an outside diameter at said inner end larger than the minimum diameter of said internal taper of said article, wherein said cylindrical member serves a dual function, that of providing pressurized grease to said shaft through said grease fitting and through said cylindrical member to loosen said article on said shaft, and that of providing a stop so that said article cannot be removed from said shaft until said removal fitting is removed from said shaft.

* * * * *

UNITED STATES PATENT AND TRADEMARK OFFICE

CERTIFICATE OF CORRECTION

PATENT NO. : 4,829,718

DATED : May 16, 1989

INVENTOR(S) : Michael E. Behm

It is certified that error appears in the above-identified patent and that said Letters Patent is hereby corrected as shown below:

On the cover sheet:

Insert under "U.S. PATENT DOCUMENTS":

| | | | |
|---|---|---|---|
| 3,061,342 | 10/1962 | T. R. Feller | 287/53 |
| 4,154,543 | 5/1979 | Moewe et al | 403/15 |
| 4,393,626 | 7/1983 | Schroer | 51/168 |

Signed and Sealed this

Twenty-seventh Day of March, 1990

*Attest:*

JEFFREY M. SAMUELS

*Attesting Officer*

*Acting Commissioner of Patents and Trademarks*